US011700975B1

(12) United States Patent
Clark

(10) Patent No.: US 11,700,975 B1
(45) Date of Patent: Jul. 18, 2023

(54) BATHING CHAIR

(71) Applicant: Glen D. Clark, LaPine, OR (US)

(72) Inventor: Glen D. Clark, LaPine, OR (US)

( * ) Notice: Subject to any disclaimer, the term of this patent is extended or adjusted under 35 U.S.C. 154(b) by 42 days.

(21) Appl. No.: 17/554,446

(22) Filed: Dec. 17, 2021

(51) Int. Cl.
*A47K 3/12* (2006.01)
*A61G 7/10* (2006.01)

(52) U.S. Cl.
CPC ..... *A47K 3/122* (2013.01); *A61G 7/1003* (2013.01); *A61G 7/1059* (2013.01)

(58) Field of Classification Search
CPC ..... A47K 3/122; A47K 3/125; A61G 7/1059; A61G 7/1003
See application file for complete search history.

(56) References Cited

U.S. PATENT DOCUMENTS 2,752,610 A 7/1956 Mabrey
3,209,375 A 10/1965 Parsons
4,287,619 A 9/1981 Brewer et al.
4,949,929 A * 8/1990 Kesselman ..... A47B 96/06 248/300
5,357,639 A * 10/1994 Zellner ..... A47K 3/122 4/605
5,373,591 A 12/1994 Myers
5,517,704 A * 5/1996 Dagostino ..... A61G 7/1059 4/578.1
5,558,022 A * 9/1996 Mason ..... A61G 7/1003 104/126
6,721,966 B2 4/2004 Costonde
6,807,690 B1 * 10/2004 Satterfield ..... A47K 3/282 297/14
6,820,290 B1 11/2004 Mullick et al.
7,661,154 B2 * 2/2010 Cheng ..... A47K 3/122 4/578.1
8,393,020 B2 * 3/2013 Grant ..... A47K 3/281 211/175
8,800,069 B2 8/2014 Culwell
10,245,198 B2 * 4/2019 Lucas ..... A61G 7/1046
2008/0141446 A1 6/2008 Dupuis
2013/0117928 A1 * 5/2013 Hardie ..... A61G 7/1059 4/611
2019/0014953 A1 * 1/2019 Shields ..... A47C 15/004

* cited by examiner

*Primary Examiner* — Janie M Loeppke
(74) *Attorney, Agent, or Firm* — Cramer Patent & Design, PLLC; Aaron R. Cramer

(57) ABSTRACT

A bathing chair is a removable toilet seat having a pair of handles having a plank extending from a first side of the toilet seat suitable to permit a user to slide from the toilet seat across the plank. The bathing chair also has a wall support which may be removably secured to a shower or bath wall. The wall support retains the plank in a horizontal position of a tub or shower area.

17 Claims, 8 Drawing Sheets

BATHING CHAIR

RELATED APPLICATIONS

None.

FIELD OF THE INVENTION

The presently disclosed subject matter relates generally to a chair and more specifically to a chair to assist in bathing.

BACKGROUND OF THE INVENTION

Individuals that care for people with physical disabilities, such as the elderly and handicapped, know all too well of some of the difficulties that they encounter while caring for their charges. Assistance that they lend occupies a great deal of time and sometime places a great deal of emotional as well as physical strain on them as well. What comes easily to those that are not physically challenged, such as climbing stairs or bending down to tie his or her shoes, requires extreme physical exertion or, worse yet, is altogether impossible to accomplish without the help provided by the care giver. Among these difficulties, getting into and out of a bathtub is a common occurrence.

Not only is this process difficult to navigate, but it is also extremely dangerous as one must risk serious injury or even death arising from slipping and/or falling-down. Shower chairs are available to assist in such instances but still require the user to climb over the sidewalls of the tub which place the user in an unstable position that is likely to result in a fall. As a result, many people are forced to either bathe less frequently or they must obtain the assistance of one or more people to help them. Accordingly, there exists a need for a means by which those with physical disabilities can bathe in a tube easily and in a safe manner while placing less strain on their care givers. The development of the Bathing Chair fulfills this need.

SUMMARY OF THE INVENTION

The principles of the present invention provide for a bathing chair has a bathtub which has a first tub side and a second tub side, a fixed frame which spans across the first tub side and the second tub side, a pair of sliding tracks which are attached to an inner portion of the fixed frame, a wall mounting plate which is attached to the second tub side of the fixed frame to a tub wall, a plurality of mounting slots which are disposed on the wall mounting plate, a chair assembly which is disposed on top of the fixed frame, a locking lever disposed on a side of the chair assembly to prevent rotation of the chair assembly, a movable frame which has a pair of side pieces and a pair of end pieces and, a pair of intermediate pieces which are disposed on a middle of the movable frame and are connected to the pair of side pieces that are used to support a swivel base. The swivel base connects the movable frame to the chair assembly. The mounting slots allow a plurality of fasteners to attach the fixed frame into a structural element. The chair assembly includes a seat. The pair of side pieces are mechanically attached to the pair of sliding tracks.

The first tub side of the fixed frame may be attached to a top plate above a flexible drip water skirt that redirects any dripping water away from the bathing chair. The top plate is supported by a pair of support legs on the first tub side such that no pressure is placed on top of the first tub side. Each of the pair of support legs may include an adjustable foot to compensate for different distances between the first tub side and a floor surface. Each of the adjustable feet may allow for adjustment to the floor surface via friction fit. Each of the adjustable feet may be threaded and are adjusted by turning along a rotational travel path. The pair of support legs may be attached with a pair of mounting brackets. The second tub side may be adapted to support a load of up to 500 lbs.

The pair of sliding tracks may cantilever outwards to a tub exterior space along a sliding travel path. The wall mounting plate and the swivel base may be made of galvanized steel. The wall mounting plate and the swivel base may be made of stainless steel. The fasteners may be a plurality of screws. The fasteners may be a plurality of lag bolts. The bathing chair may further have a back rest which may be attached to the seat by a pair of back support members. The bathing chair may also have a pair of arm rests attached to the seat by a pair of arm rest support members and a trough which may be disposed in a middle portion of the seat adapted to allow excess water below a seated user to run off. The chair assembly may be centered over the bathtub in a retracted position such that water drips from the chair assembly. The swivel base may include a swivel chair and a pivot point and a plurality of bearings. The swivel base may include a 360° circular travel path. The bathing chair may be adapted to slide in and out of the bathtub by a disabled person.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
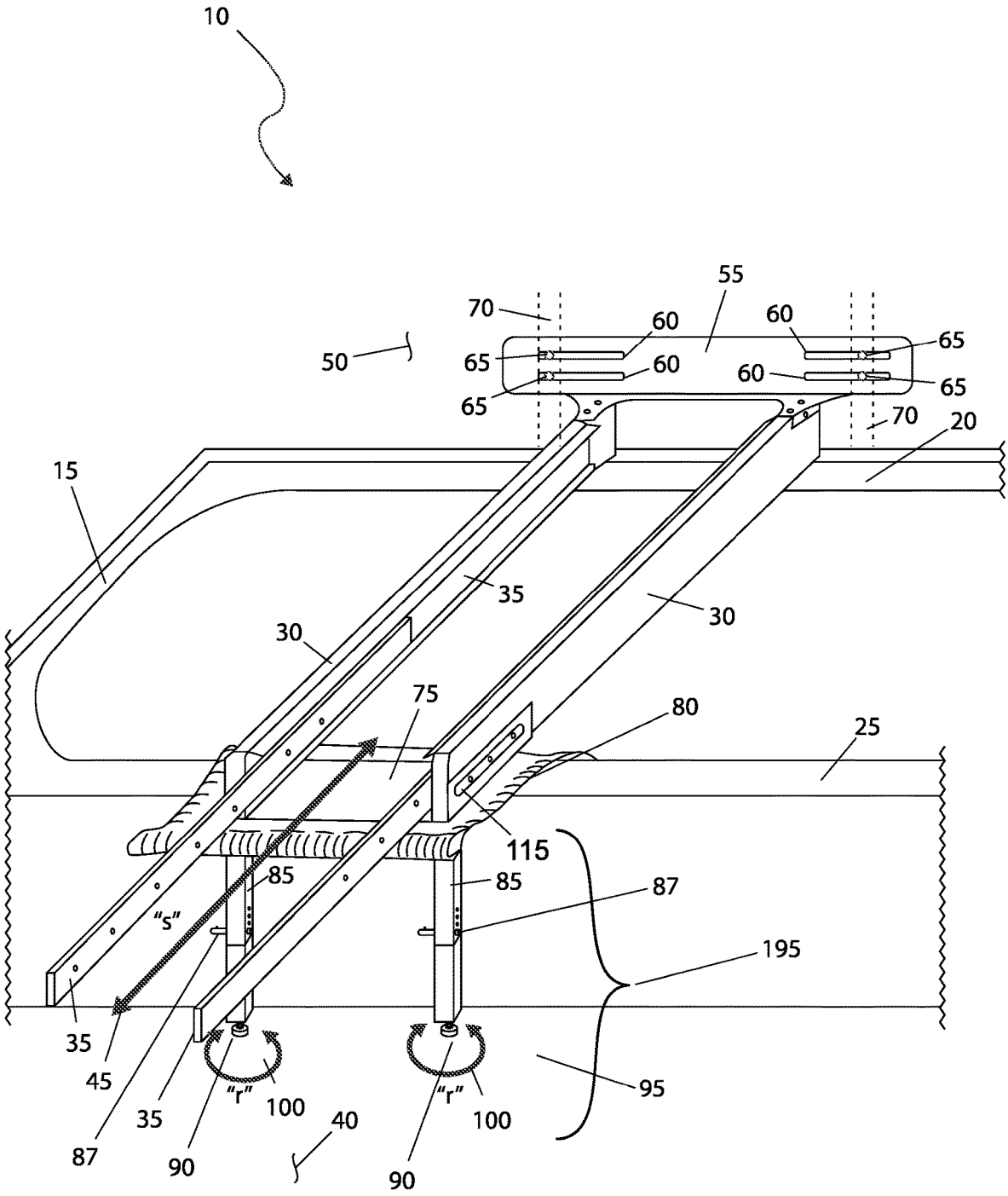
FIG. 1 is a partial perspective view of the bathing chair 10, in an extended state, according to the preferred embodiment of the present invention.

10 bathing chair
15 bathtub
20 distal tub side/2nd tub side
25 proximal tub side/1st tub side
30 fixed frame
35 ball bearing-style sliding track
40 exterior tub space
45 sliding travel path "s"

50 tub wall
55 wall mounting plate
60 mounting slot
65 fasteners
70 structural element
75 top plate
80 drip water skirt
85 adjustable support leg
87 adjustable pin and lock
90 adjustable foot
95 floor
100 rotational travel path "r"
105 chair assembly
110 locking lever
115 mounting bracket
120 movable frame
125 side piece
130 end piece
135 intermediate piece
140 swivel base
145 circular travel path 'C"
150 seat
155 back rest
160 back support member
165 arm rest
170 arm rest support member
175 trough
180 user
185 distal leg
190 proximal leg
195 floor support
200 cut-out

DESCRIPTION OF THE PREFERRED EMBODIMENTS

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the bathing chair 10, according to the preferred embodiment of the present invention is disclosed. The bathing chair (herein also described as the "device") 10, provides for a bathing chair that slides in and out of a tub for use by disabled individuals or care provider. The device 10 is supported above a bathtub 15 at a distal tub side/2nd tub side 20 and a proximal tub side/1st tub side 25. A fixed frame 30 spans the distance between the distal tube side 20 and the proximal tub side/1st tub side 25. Two (2) ball bearing style-sliding tracks 35 are attached to the inner portion of the fixed frame 30. The wall mounting plate 55, adjustable support legs 85, fixed frame 30 and ball bearing style sliding track 35 will support a load of five hundred pounds (500 lbs.). The proximal tub side/1st tub side 25 is capable of supporting a load of five hundred pounds (500 lbs.). The configuration and function of the ball bearing-style sliding track 35 will be explained in greater detail herein below. The movable ball bearing style sliding track 35 cantilever outwards to a tub exterior space 40 along a sliding travel path "s" 45. The distal side of the fixed frame 30 is attached to the tub wall 50 via use of a wall mounting plate 55 envisioned to be made of galvanized or stainless steel. The wall mounting plate 55 is provided with a plurality of mounting slots 60 to allow the use of fasteners 65 such as screws or lag bolts to attach into structural elements 70 such as wall studs (here shown by dashed lines due to their hidden nature). The proximal side of the fixed frame 30 is attached to floor support 195. The floor support 195, will be described in greater detail herein below. The drip water skirt 80 serves to redirect dripping water away from the components of the device 10 and the floor 95 and back into the tub 15. The top plate 75 is supported by two (2) adjustable support legs 85 on the proximal side such that no pressure is placed on top the proximal tub side/1st tub side 25. The overall floor support 195 ensure that no pressure is placed on top of the proximal tub side/1st tub side 25. Each support leg 85 is provided with and adjustable pin and lock 87 to compensate and the floor 95. Each adjustable support leg 85 will also have an adjustable foot 90 that will be threaded and are adjusted by turning along a rotational travel path "r" 100. The first tub side 25 of the fixed frame 30 may be attached to the top plate 75, the flexible drip water skirt 80 slides up under the top plate 75 to redirect water away from the bathing chair 10 and back into the bathtub 15. The flexible water skirt 80 may be under the top plate 75, which is part of the floor support. and redirects falling or dripping water back into the bathtub 15.

Figure 2:
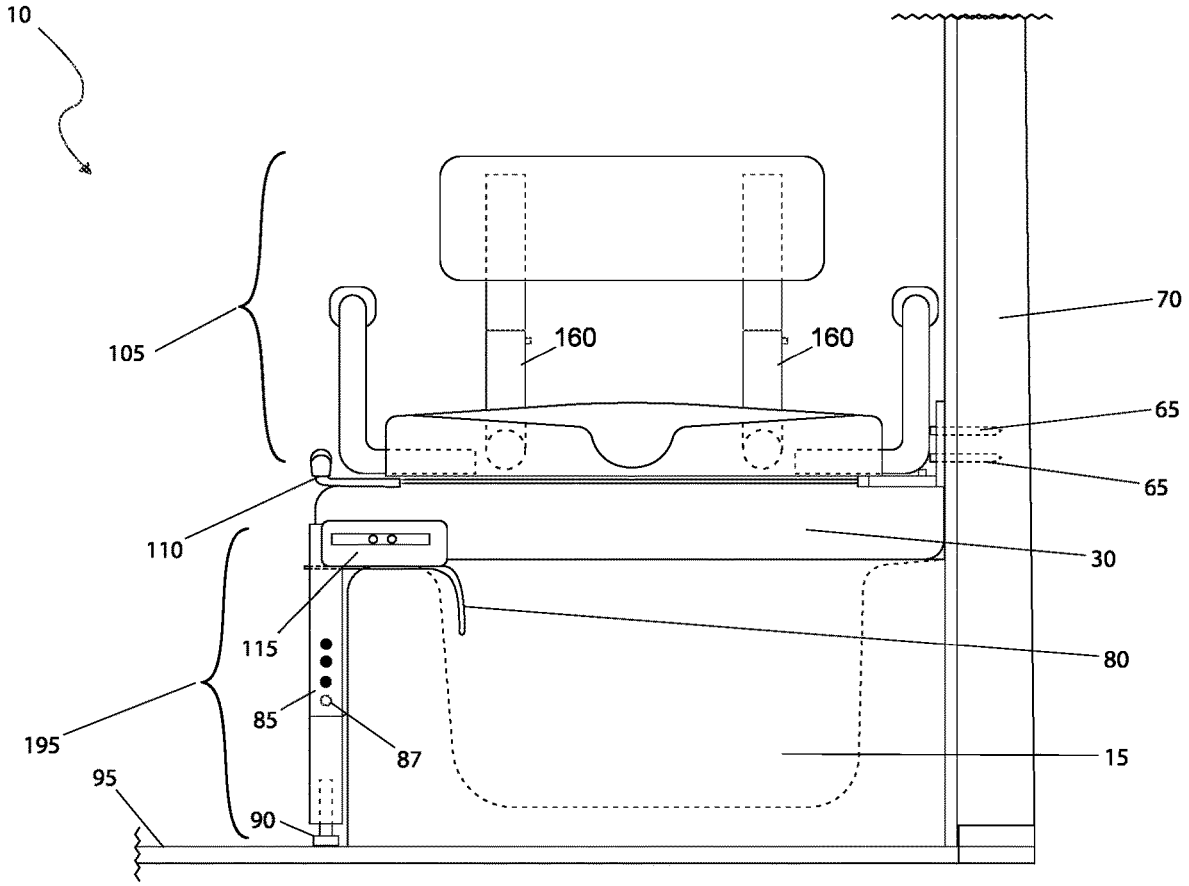
FIGS. 2 and 2*a*, are a front view of the device 10, shown in a retracted state and an extended state respectively, according to the preferred embodiment of the present invention.
Figure 2A:
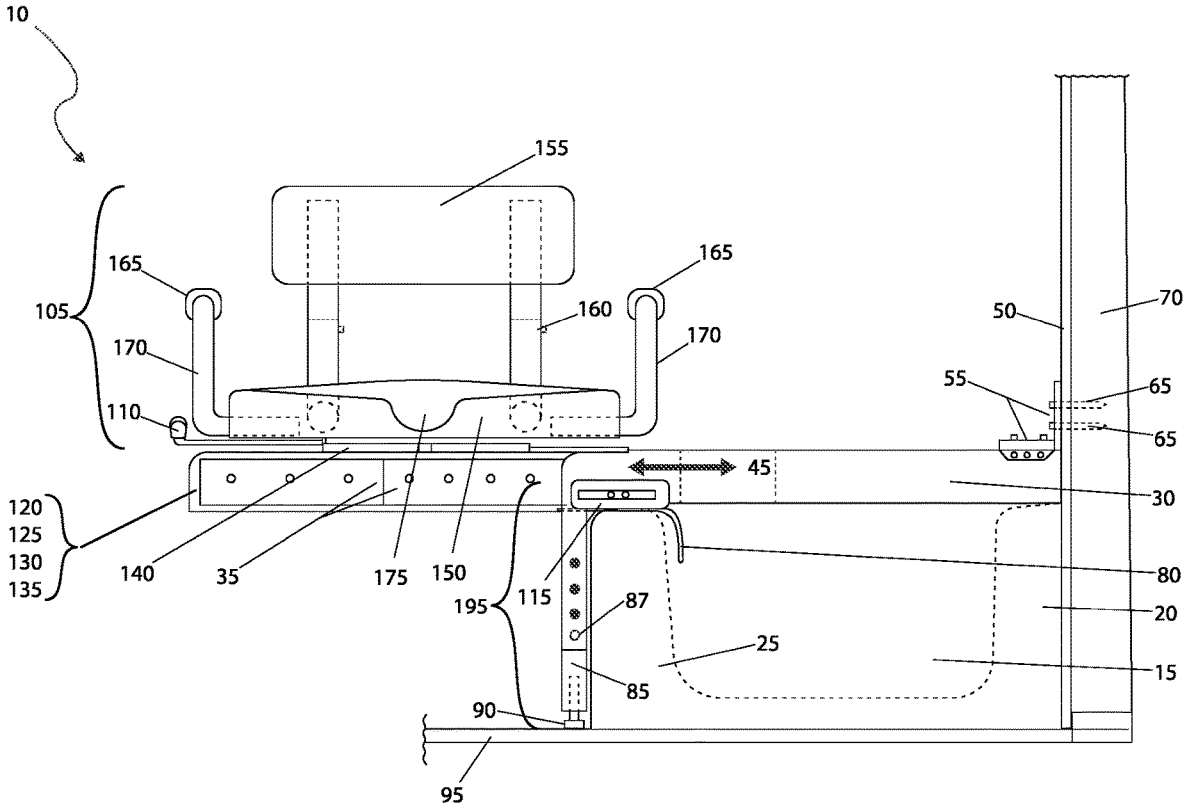

Referring next to FIGS. 2 and 2*a*, a front view of the device 10, shown in a retracted and extended state respectively, according to the preferred embodiment of the present invention is depicted. A chair assembly 105 is provided on top of the fixed frame 30 and will be described in greater detail herein below. A locking lever 110 is provided on the side of the chair assembly 105 to prevent rotation and will be described in greater detail herein below. In its retracted position as shown, the chair assembly 105 is centered over the bathtub 15 such that water drips from the user 180 and chair assembly 105 into the bathtub 15. The proximal portion of the device is supported by a floor support 195, as will be described in greater detail herein below. The penetration of the fasteners 65 into the structural elements 70 are also visible via hidden lines in this view. The adjustable nature of the adjustable foot 90 allow for tight adjustment to the floor 95 where they remain in place via friction fit. Any adjustment in height due to floor coverings such as tile can be accounted for using the adjustable foot 90. As the only physical connection between the device 10 and any permanent surfaces in the bathroom remain the fasteners 65, should the device 10 be removed from the bathtub 15, no tell-tale marks or holes that are difficult to repair are left behind.

Figure 3:
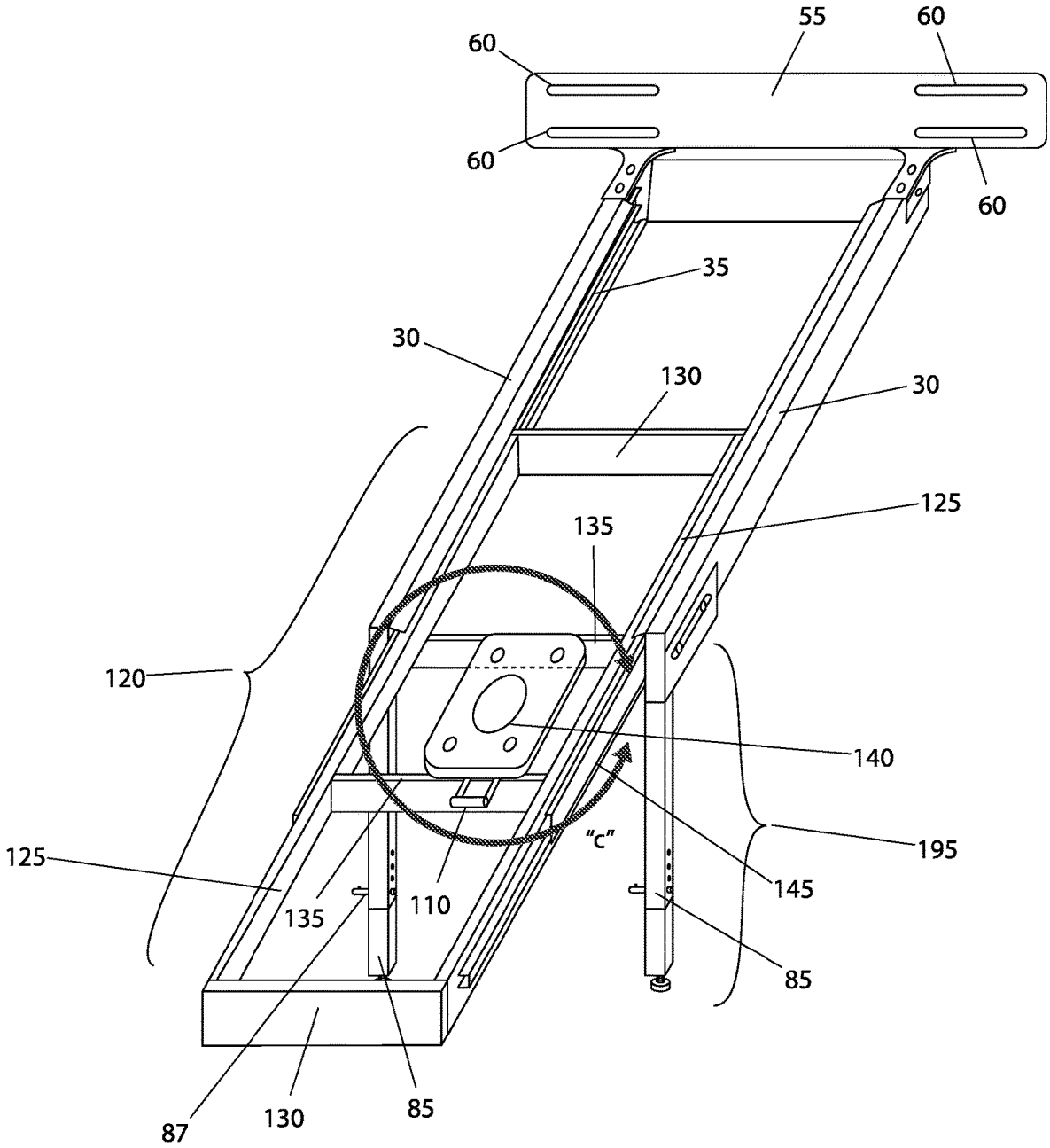
FIG. 3 is a partial view of the fixed frame 30 with a movable frame 120, as used with the bathing chair 10, according to the preferred embodiment of the present invention.

Referring now to FIG. 3, a partial view of the fixed frame 30 with a movable frame 120, as used with the device 10, according to the preferred embodiment of the present invention is shown. The movable frame 120 includes two (2) side pieces 125 and two (2) end pieces 130 and one intermediate piece 135. The side pieces 125 are mechanically attached to the ball bearing style-sliding track 35. Two (2) intermediate pieces 135 located in the middle of the movable frame 120 and connected to the side pieces 125 are used to support a swivel base 140. The swivel base 140 connects the movable frame 120 to the chair assembly 105 (as shown in FIG. 2). The swivel base 140 is a typical component of a swivel chair and is provided with a pivot point, bearings. Nylon slides and/or other components as typically expected. The two (2) ball bearing style-sliding tracks 35 are built with five hundred pounds (500 lb) ball bearing slides with locks on the extended position for safety of the user 180. During use, the swivel base 140 provides for a three hundred-sixty degree (360° circular travel path 'C" 145. The locking lever 110 prevents said movement and locks the swivel base 140 into a static position. The swivel base 140 is made of galvanized steel, stainless steel or similar non corroding material. In its extended position as shown, the swivel base 140, and thus the chair assembly 105, would be located on the exterior tub space 40 (as shown in FIG. 2).

Figure 4:
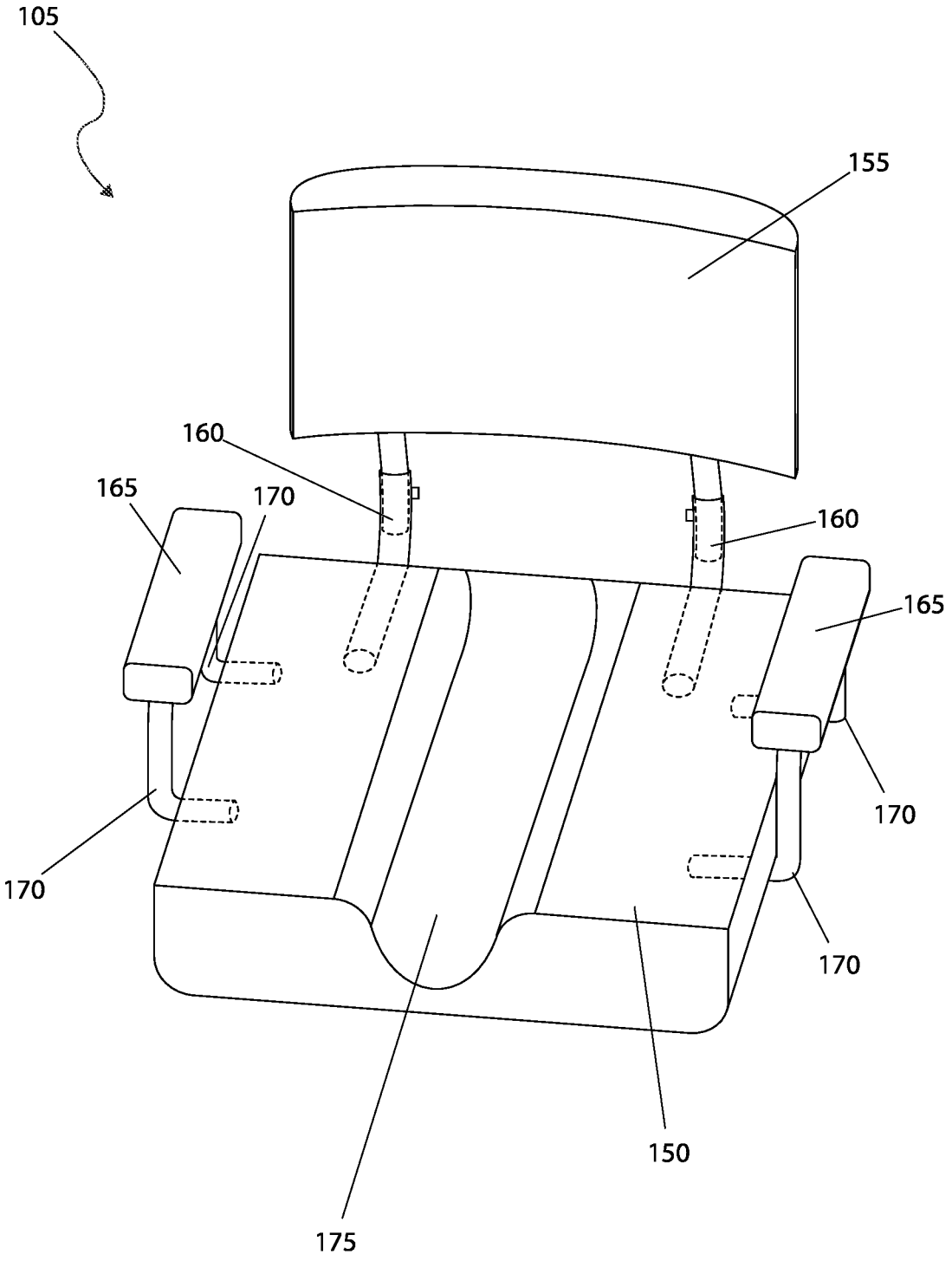
FIG. 4 is a perspective view of the chair assembly 105 as used with the bathing chair 10, according to the preferred embodiment of the present invention.
Figure 5:
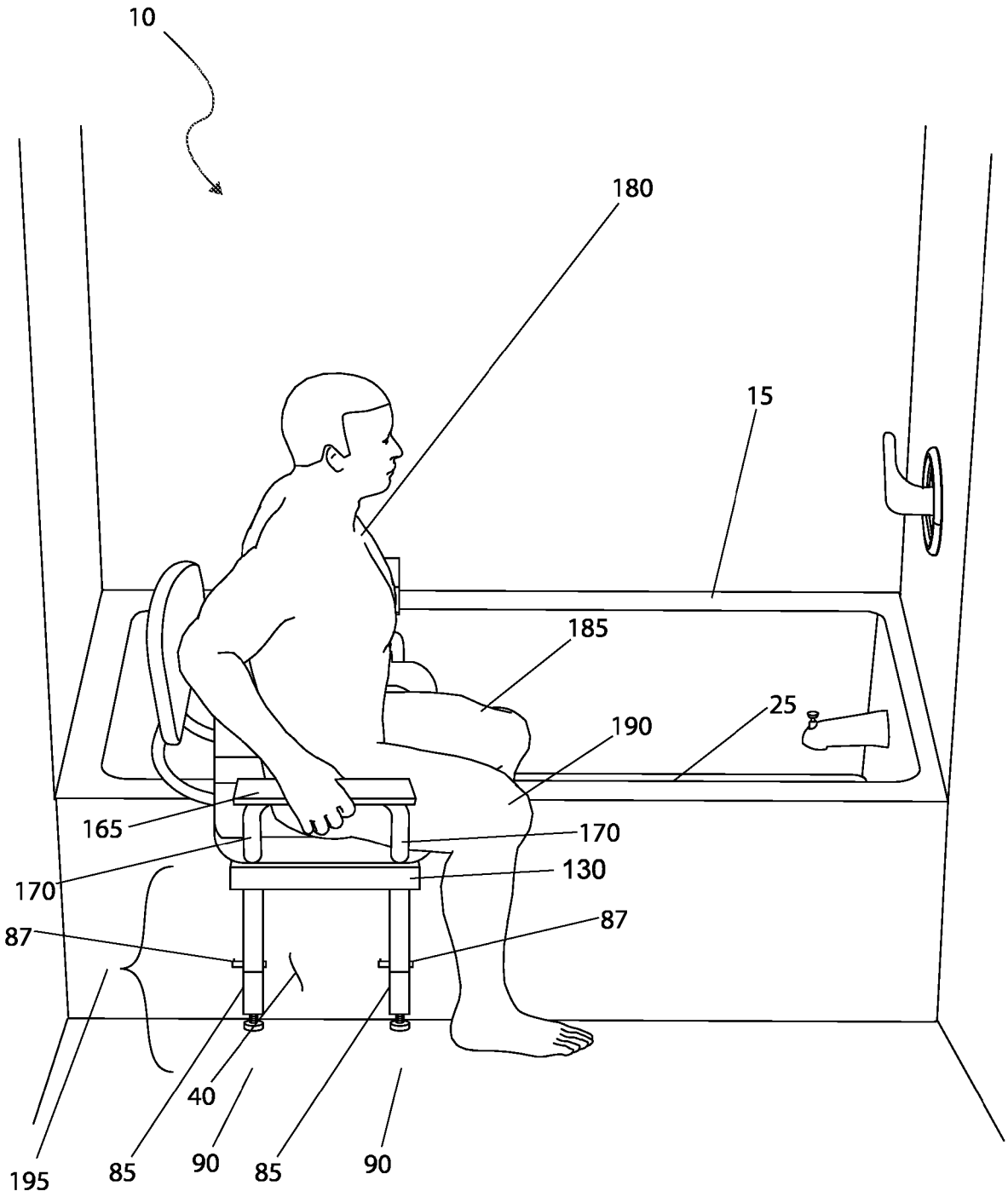
FIG. 5 is a perspective view of the bathing chair 10, shown in a utilized state, according to the preferred embodiment of the present invention.

Referring next to FIG. 4, a perspective view of the chair assembly 105 as used with the device 10, according to the preferred embodiment of the present invention is disclosed. The chair assembly 105 includes a seat 150 complete with a back rest 155. The back rest 155 is attached to seat 150 by two (2) back support members 160. Two (2) arm rests 165 are also attached to the seat 150 by two (2) arm rest support members 170 each. The seat 150, the back rest 155, and the arm rests 165 are envisioned to be made of plastic or similar non-corroding material. A trough 175 is provided in the middle of the seat 150 to allow excess water below a seated user 180 to run off Referring now to FIG. 5, a perspective view of the device 10, shown in a utilized state, according to the preferred embodiment of the present invention is depicted. With the chair assembly 105 in an extended state over the exterior tub space 40, and the locking lever 110 (not shown due to illustrative limitations) disengaged to allow movement of the chair assembly 105 along the circular travel path 'C" 145 (as shown in FIG. 3), a user 180 transitions to the chair assembly 105 from a standing position, from a wheelchair, from crutches, a cane, or the like. The arm rests 165 are grabbed to assist in the transition. Once seated, the chair assembly 105 is moved along the sliding travel path "s" 45 (as shown in FIG. 1) until the movable frame 120 (as shown in FIG. 3) contacts the fixed frame 30 (as shown in FIG. 1) at the distal tub side/2nd tub side 20 (as shown in FIG. 1). During movement, the user 180 lifts their distal leg 185 up and over the proximal tub side/1st tub side 25 (as shown in FIG. 1) until inside the bathtub 15. Progress then continues along the sliding travel path "s" 45 towards the tub wall 50 (as shown in FIG. 1) until the proximal leg 190 contacts the proximal tub side/1st tub side 25. The lifting process is repeated with the proximal leg 190 until the chair assembly 105, and the user 180, is fully within the bathtub 15 as shown in FIG. 2. The locking lever 110 is manipulated to lock the seat 150 into the desired position, whereupon bathing may commence. At the completion of bathing, the above-mentioned process is reversed to allow the user 180 to transition away from the device 10.

Figure 6:
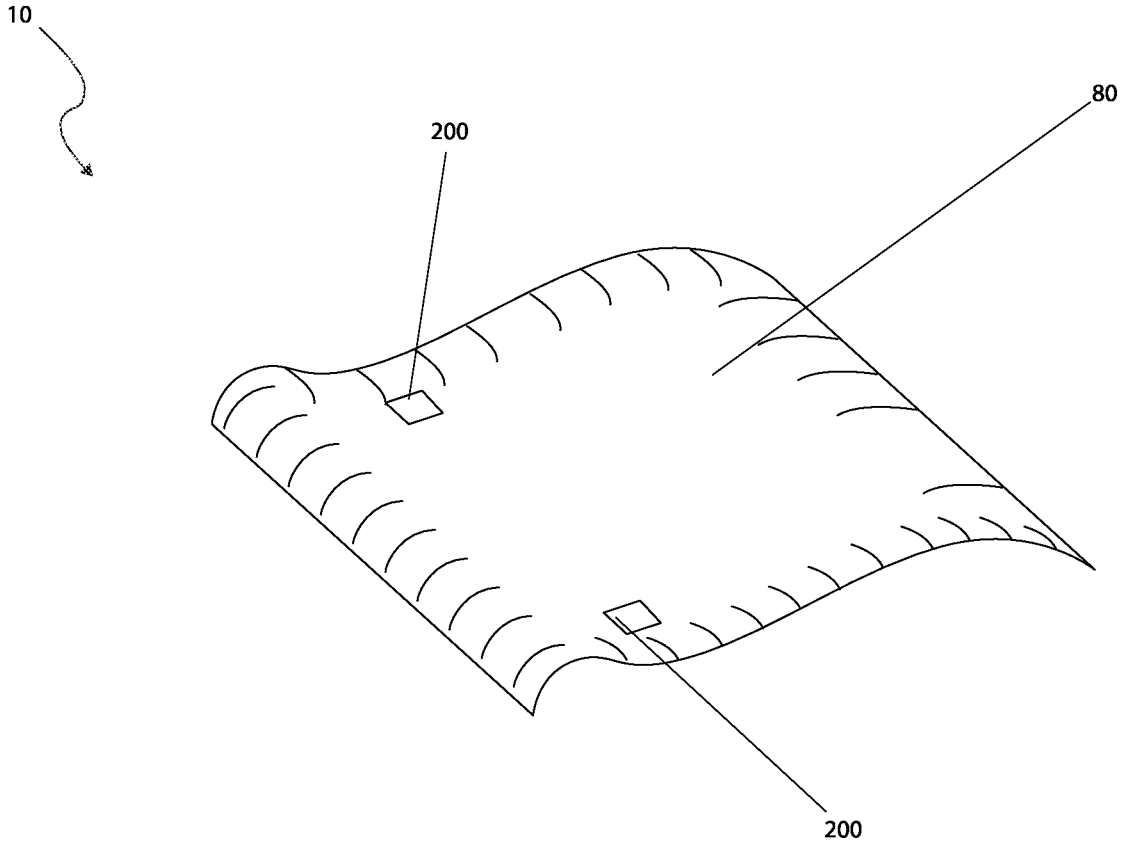
FIG. 6 is a perspective view of the drip water skirt 80, as used with the bathing chair 10, according to the preferred embodiment of the present invention; and, FIG. 7 is a perspective view of the floor support 195, as used with the bathing chair 10, according to the preferred embodiment of the present invention.
Figure 7:
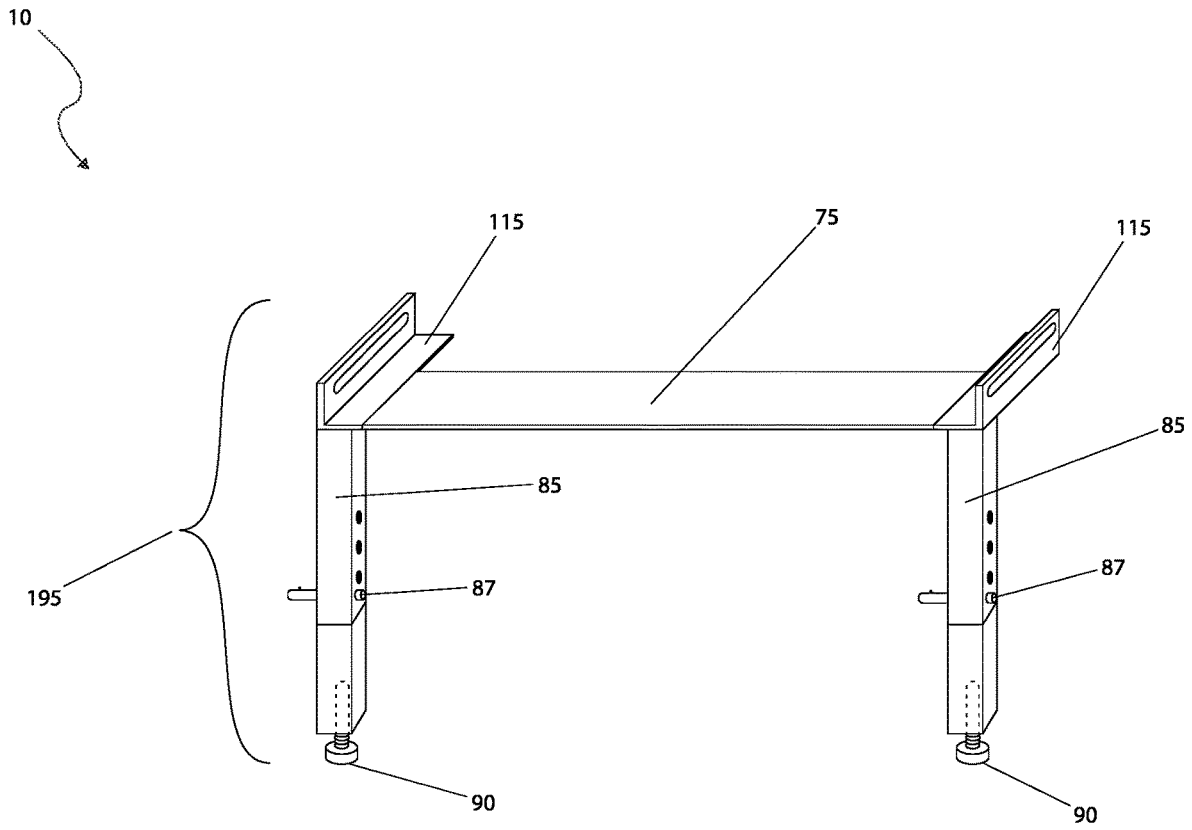

Referring next to FIG. 6, a perspective view of the drip water skirt 80, as used with the bathing chair 10, according to the preferred embodiment of the present invention is shown. The drip water skirt 80 would be made of plastic in an injection molding process to produce a preformed component. The drip water skirt 80 is provided with two (2) cut-outs 200 to fit around the adjustable support legs 85. The cut-outs 200 allow the drip water skirt 80 to slide up the adjustable support legs 85 and fit under the floor support 195 (as shown in FIG. 7) in a form fitting manner so as to not allow water to leak down the adjustable support legs 85. Additionally, as the drip water skirt 80 is under the floor support 195, falling or dripping water will be redirected back into the tub 15 (as shown in FIG. 1).

Referring to FIG. 7, a perspective view of the floor support 195, as used with the bathing chair 10, according to the preferred embodiment of the present invention is disclosed. The floor support 195 comprises the top plate 75, two (2) mounting brackets 115, two (2) adjustable support legs 85, two (2) adjustable pins and locks 87, and two (2) adjustable feet 90. The floor support 195 would be manufactured as one component using metal stamping and welding operations. The adjustable support legs 85 will compensate for the different distances between the top of the first tub side/proximal tub side/1st tub side 25 and the floor 95. Also, each adjustable support leg 85 includes an adjustable foot 90 that is threaded and adjusted by turning along a rotational travel path "r" 100 to allow fine adjustment of the height to different floor 95 surfaces via friction fit. The two (2) mounting brackets 115 connect the floor support 195 to the fixed frame 30 and allows for adjustments of the fixed frame 30 for different widths of tubs.

2. Operation of the Preferred Embodiment

The preferred embodiment of the present invention can be utilized by the common user 180 in a simple and effortless manner with little or no training. It is envisioned that the device 10 would be constructed in general accordance with FIG. 1 through FIG. 7. The user 180 would procure the device 10 from conventional procurement channels such as hardware stores, home improvement stores, medical equipment supply houses, mail order and internet supply houses and the like. Special attention would be paid to what type of bathtub 15 the device 10 is to be used upon and whether the device 10 is to be installed as a right- or left-handed unit.

After procurement and prior to utilization, the device 10 would be installed in the following manner: the fully assembled device 10 would be set upon the bathtub 15 as shown in FIG. 1, with assurances that clearances are provided for the sliding travel path "s" 45 and the circular travel path 'C" 145. Once a proper position has been obtained, the wall mounting plate 55 is secured to the structural elements 70 using fasteners 65. The adjustable support legs 85 would be adjusted in overall height using both the adjustable pin and lock 87 as well as the adjustable foot 90 on each support leg 85 to ensure that the fixed frame 30 is level. Such a configuration will withstand the mechanical movement of the user 180 sitting upon the device 10 when the chair assembly 105 is positioned at the exterior tub space 40. At this point in time, the device 10 is ready for use.

During utilization of the device 10, the following procedure would be initiated: the chair assembly 105 is positioned in an extended state over the exterior tub space 40 with the locking lever 110 disengaged; the user 180 transitions to the chair assembly 105 using the arm rests 165 for support and balance as needed; the chair assembly 105 is moved along the sliding travel path "s" 45 until the distal leg 185 contacts the proximal tub side/1st tub side 25; the user 180 lifts their distal leg 185 up and over the proximal tub side/1st tub side 25 until inside the bathtub 15; inward progress then continues along the sliding travel path "s" 45 towards the interior of the bathtub 15 until the proximal leg 190 contacts the proximal tub side/1st tub side 25; the proximal leg 190 is then lifted inside of bathtub 15; and the locking lever 110 is then locked into the desired position for bathing to commence.

After use of the device 10, the user 180 removes themselves from the device 10 using the reverse process as described above. The process is then repeated as needed. Should the service of the device 10 no longer be required, it may be removed, leaving minimal tell-tale marks behind that can removed with minimal remediation efforts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A bathing chair, comprising:

a bathtub having a first tub side and a second tub side;

a fixed frame spanning across the first tub side and the second tub side of the bathtub, the fixed frame having a first tub side and a second tub side;

a pair of ball bearing-style sliding tracks attached to an inner portion of the fixed frame;

a wall mounting plate attaching the second tub side of the fixed frame to a tub wall;

a plurality of mounting slots disposed on the wall mounting plate, the mounting slots allow a plurality of fasteners to attach the fixed frame into a structural element;

a chair assembly disposed on top of the fixed frame, the chair assembly includes a seat;

a locking lever disposed on a side of the chair assembly to prevent rotation of the chair assembly to unlock the chair assembly as needed and to unlock the sliding track to travel freely along its sliding travel path;

a movable frame having a pair of side pieces and a pair of end pieces, the pair of side pieces are mechanically attached to the pair of ball bearing-style sliding tracks; and a pair of intermediate pieces disposed on a middle of the movable frame and are connected to the pair of side pieces that are used to support a swivel base, the swivel base connects the movable frame to the chair assembly;

a floor support having a top plate, a pair of mounting brackets, a pair of adjustable support legs, a pair of adjustable pins and locks, and a pair of adjustable feet;

wherein the first tub side of the fixed frame is attached to the top plate, a flexible drip water skirt slides up under the top plate to redirect water away from the bathing chair and back into the bathtub;

wherein the flexible water skirt is under the top plate, which is part of the floor support. and redirects falling or dripping water back into the bathtub;

wherein the flexible drip water skirt includes a pair of cut-outs to allow the drip water skirt to slide up the adjustable support legs and fit under the floor support in a form fitting manner so as to not allow water to leak down the adjustable support legs;

wherein the floor support ensures that no pressure is placed on top of the first tub side;

wherein the pair of ball bearing-style sliding tracks cantilever outwards to a tub exterior space along a sliding travel path.

2. The bathing chair, according to claim 1, wherein each of the pair of support legs include an adjustable foot to compensate for different distances between the first tub side of the bathtub and a floor surface.

3. The bathing chair, according to claim 2, wherein each of the adjustable feet allow for adjustment to the floor surface via friction fit.

4. The bathing chair, according to claim 2, wherein each of the adjustable feet are threaded and are adjusted by turning along a rotational travel path.

5. The bathing chair, according to claim 1, wherein the floor support is manufactured as one component.

6. The bathing chair, according to claim 1, wherein the second tub side of the fixed frame is adapted to support a load of up to 500 lbs.

7. The bathing chair, according to claim 1, wherein the wall mounting plate and the swivel base are made of galvanized steel.

8. The bathing chair, according to claim 1, wherein the wall mounting plate and the swivel base are made of stainless steel.

9. The bathing chair, according to claim 1, wherein the fasteners are a plurality of screws.

10. The bathing chair, according to claim 1, wherein the fasteners are a plurality of lag bolts.

11. The bathing chair, according to claim 1, further comprising a back rest attached to the seat by a pair of back support members.

12. The bathing chair, according to claim 1, further comprising a pair of arm rests attached to the seat by a pair of arm rest support members.

13. The bathing chair, according to claim 1, further comprising a trough disposed in a middle portion of the seat adapted to allow excess water below a seated user to run off.

14. The bathing chair, according to claim 1, wherein the chair assembly is centered over the bathtub in a retracted position such that water drips from the chair assembly.

15. The bathing chair, according to claim 1, wherein the swivel base includes a swivel chair and a pivot point and a plurality of bearings.

16. The bathing chair, according to claim 1, wherein the swivel base includes a 360° circular travel path.

17. The bathing chair, according to claim 1, wherein the bathing chair is adapted to slide in and out of the bathtub by a disabled person.

* * * * *